US011666807B2

(12) United States Patent
Tachibana et al.

(10) Patent No.: US 11,666,807 B2
(45) Date of Patent: Jun. 6, 2023

(54) GOLF CLUB

(71) Applicant: Sumitomo Rubber Industries, Ltd., Hyogo (JP)

(72) Inventors: Kosuke Tachibana, Kobe (JP); Takashi Nakamura, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/578,304

(22) Filed: Jan. 18, 2022

(65) Prior Publication Data

US 2022/0226701 A1 Jul. 21, 2022

(30) Foreign Application Priority Data

Jan. 21, 2021 (JP) ..... JP2021-008207

(51) Int. Cl.

| | |
|---|---|
| ***A63B 53/04*** | (2015.01) |
| ***A63B 53/06*** | (2015.01) |
| ***A63B 53/02*** | (2015.01) |
| ***A63B 60/02*** | (2015.01) |

(52) U.S. Cl.

CPC ..... *A63B 53/0466* (2013.01); *A63B 53/02* (2013.01); *A63B 53/0433* (2020.08); *A63B 53/06* (2013.01); *A63B 60/02* (2015.10); *A63B 2053/0491* (2013.01)

(58) Field of Classification Search

CPC ..... A63B 53/04; A63B 2053/0491
USPC ..... 473/324–350
See application file for complete search history.

(56) References Cited

U.S. PATENT DOCUMENTS

| | | | | |
|---|---|---|---|---|
| 5,354,054 | A * | 10/1994 | Akatsuka | A63B 53/04 473/316 |
| 5,629,475 | A * | 5/1997 | Chastonay | A63B 53/0466 73/65.03 |
| 7,186,190 | B1 * | 3/2007 | Beach | A63B 53/0466 473/335 |
| 7,744,484 | B1 * | 6/2010 | Chao | A63B 60/02 473/409 |
| 7,749,096 | B2 * | 7/2010 | Gibbs | A63B 53/0466 473/335 |
| 7,771,291 | B1 * | 8/2010 | Willett | A63B 53/0466 473/345 |
| 9,333,400 | B2 * | 5/2016 | Girard | A63B 53/06 |

(Continued)

FOREIGN PATENT DOCUMENTS

| | | | | |
|---|---|---|---|---|
| CN | 1962004 A * | 5/2007 | | A63B 53/00 |
| EP | 0556502 A1 * | 8/1993 | | |

(Continued)

*Primary Examiner* — Alvin A Hunter
(74) *Attorney, Agent, or Firm* — Studebaker & Brackett PC

(57) ABSTRACT

A golf club comprises a shaft, a golf club head fixed to one of ends of the shaft, and a grip attached to the other of the ends of the shaft and defining a grip end. The golf club head comprises a head main body and at least one weight. The head main body includes a plurality of ports for attaching the at least one weight. Each weight can be attached to and detached from each port so that the position of the center of gravity of the head can be changed by changing the position between the ports. The difference between a maximum value and a minimum value of linear distances from the grip end to the center of gravity of the weights when attached to the respective ports is not more than 20 mm.

18 Claims, 12 Drawing Sheets

(56) References Cited

U.S. PATENT DOCUMENTS 10,035,049 B1 * 7/2018 Nielson ..... A63B 60/52
2005/0181884 A1 * 8/2005 Beach ..... A63B 53/0466 473/131
2005/0209021 A1 * 9/2005 Hoffman ..... A63B 53/0466 473/334
2005/0221911 A1 * 10/2005 Beach ..... A63B 53/0466 473/338
2013/0095945 A1 * 4/2013 Nakamura ..... A63B 53/00 473/292
2013/0095946 A1 * 4/2013 Nakamura ..... A63B 53/00 473/292
2013/0095951 A1 * 4/2013 Nakamura ..... A63B 53/14 473/324
2013/0150180 A1 * 6/2013 Yamamoto ..... A63B 60/42 473/339
2014/0080629 A1 * 3/2014 Sargent ..... A63B 53/045 473/336
2014/0155190 A1 * 6/2014 Nakamura ..... A63B 53/00 473/292
2014/0206470 A1 * 7/2014 Rice ..... A63B 53/10 473/292
2014/0349779 A1 * 11/2014 Mizutani ..... A63B 53/06 473/335
2014/0357397 A1 * 12/2014 Franz ..... A63B 60/00 473/287
2014/0357402 A1 * 12/2014 Mizutani ..... A63B 53/0466 473/335
2015/0005097 A1 1/2015 Motokawa
2016/0001146 A1 * 1/2016 Sargent ..... A63B 60/00 473/336
2020/0338410 A1 * 10/2020 Mizutani ..... A63B 60/42

FOREIGN PATENT DOCUMENTS

JP 5546673 B1 * 7/2014 ..... A63B 53/00
JP 6247464 B2 12/2017
JP 6305611 B1 * 4/2018 ..... A63B 53/00
KR 20060017295 A * 2/2006
KR 20120133740 A * 12/2012
KR 20150011780 A * 2/2015
KR 20190006908 A * 1/2019
TW I227676 B * 2/2005
WO WO-9728852 A1 * 8/1997 ..... A63B 53/02
WO WO-2014157530 A1 * 10/2014 ..... A63B 53/04
WO WO-2017205699 A1 * 11/2017 ..... A63B 53/04

* cited by examiner

GOLF CLUB

BACKGROUND OF THE INVENTION

Field of the Invention

The present disclosure relates to a golf club.

Background Art

The following Patent Document 1 discloses a golf club capable of changing the position of the center of gravity of the head. The golf club comprises a golf club head provided with a first hole and a second hole. To the first hole and the second hole, a first weight member and a second weight member having different weights are detachably attached. In this golf club, by changing the mounting positions of the weight members (replace with each other), the position of the center of gravity of the head can be changed without changing the total weight of the golf club head, and thereby, the depth of the center of gravity, the moment of inertia, etc. can be changed. Patent Document 1: Japanese Patent No. 6247464

SUMMARY OF THE INVENTION

Problems to be Solved by the Invention

In the golf club as described above, however, when the mounting positions of the weight members are changed, the swing feeling may be changed before and after the mounting positions are changed.

The present disclosure was made in view of the above circumstances, and a primarily object of the present disclosure is to provide a golf club capable of changing the position of the center of gravity of the head while suppressing a change in swing feeling.

Means for Solving the Problems

According to the present disclosure, a golf club comprises a shaft, a golf club head attached to a tip end of the shaft, and a grip attached to a butt end of the shaft and defining a grip end, wherein the golf club head comprises a head main body and at least one weight, the head main body is provided with a plurality of ports for attaching the at least one weight to the head main body, the at least one weight is configured to be able to be attached to and detached from each of the plurality of ports so that, by changing a position or positions of the at least one weight, the position of the center of gravity of the head is changed, and a difference between a maximum value and a minimum value of linear distances from the grip end to positions of the respective ports is not more than 20 mm, wherein the position of each of the ports is defined by the center of gravity of the weight attached to the port.

EFFECTS OF THE INVENTION

According to the present disclosure, since the golf club is configured as above, the position of the center of gravity of the head can be changed while suppressing a change in swing feeling.

DETAILED DESCRIPTION OF THE INVENTION

Figure 1:
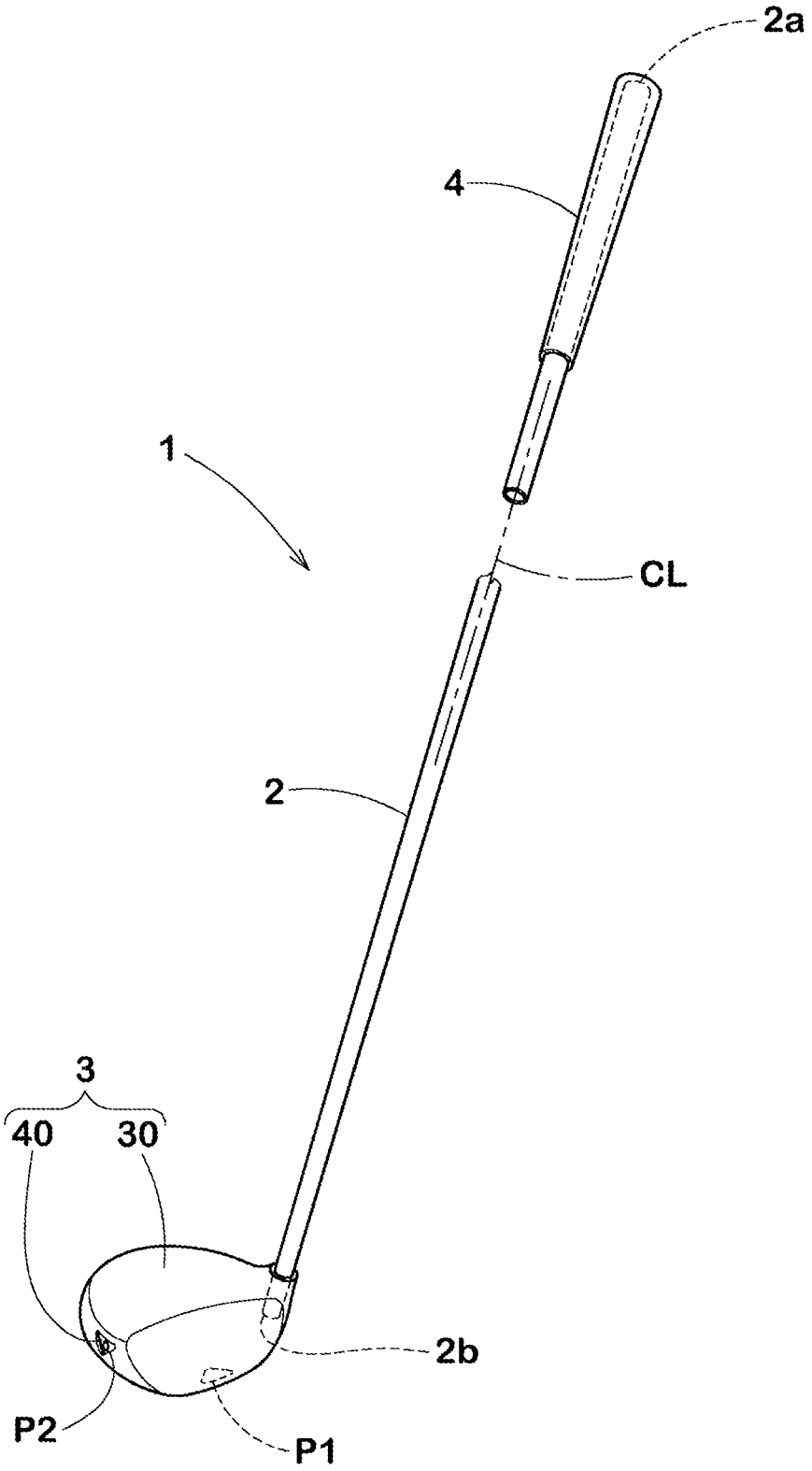
FIG. 1 is a perspective view of a golf club as an embodiment of the present disclosure.

Embodiments of the present disclosure will now be described in detail in conjunction with accompanying drawings.

It must be understood that, in order to aid the understanding of the present disclosure, the drawings contain exaggeration and depiction different from dimensional ratios of the actual structure. Further, when there are a plurality of examples, the same or common elements are designated by the same reference numerals throughout the specification, and redundant descriptions are omitted. Furthermore, the specific configurations shown in the embodiments and drawings are for understanding the contents of the present disclosure, and the present disclosure is not limited to the specific configurations shown.

[Overall Configuration]

FIG. 1 is a perspective view of a golf club 1 as an embodiment of the present disclosure. As shown in FIG. 1, the golf club 1 in the present embodiment comprises a shaft 2, a golf club club 3 and a grip 4.

[Definitions of Reference State and the Like]

Figure 2:
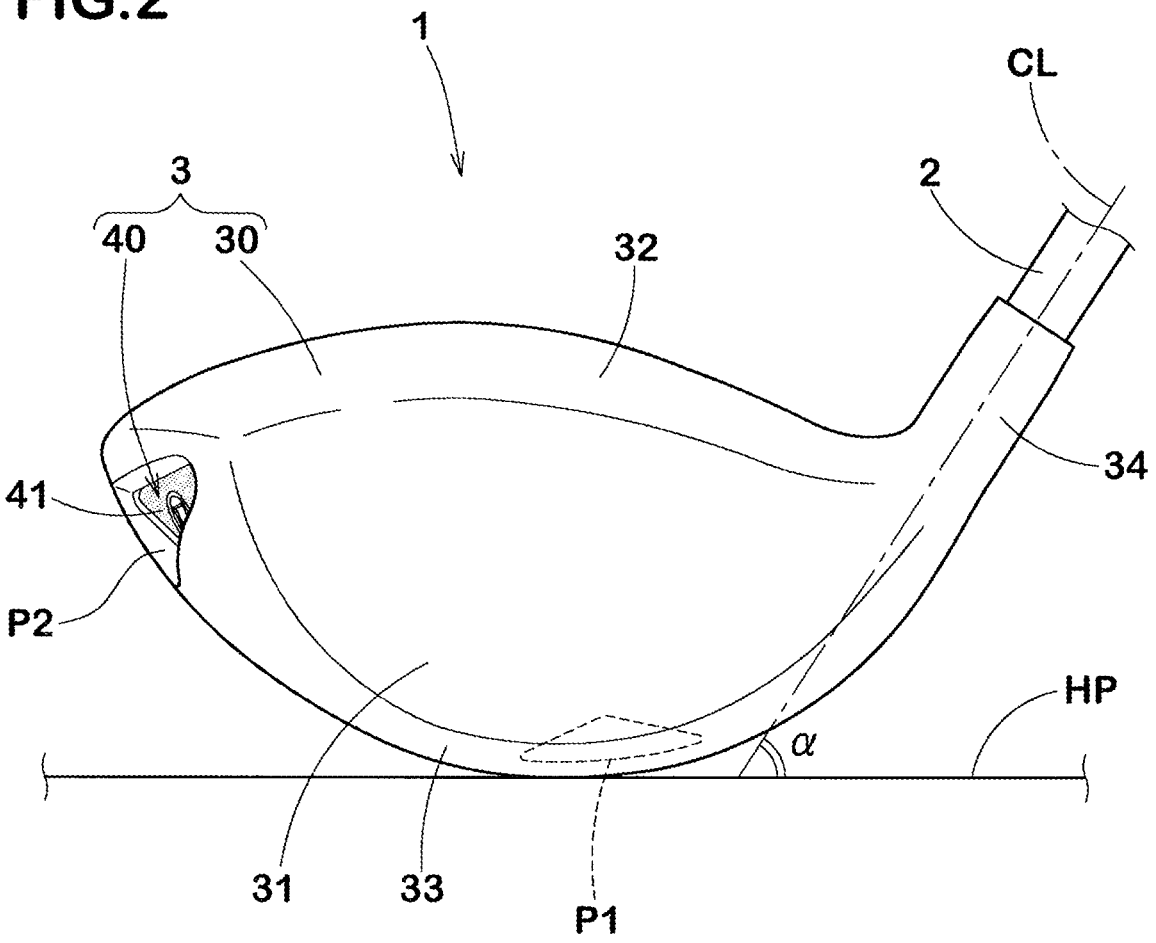
FIG. 2 is a front view of a golf club head of the golf club.
Figure 3:
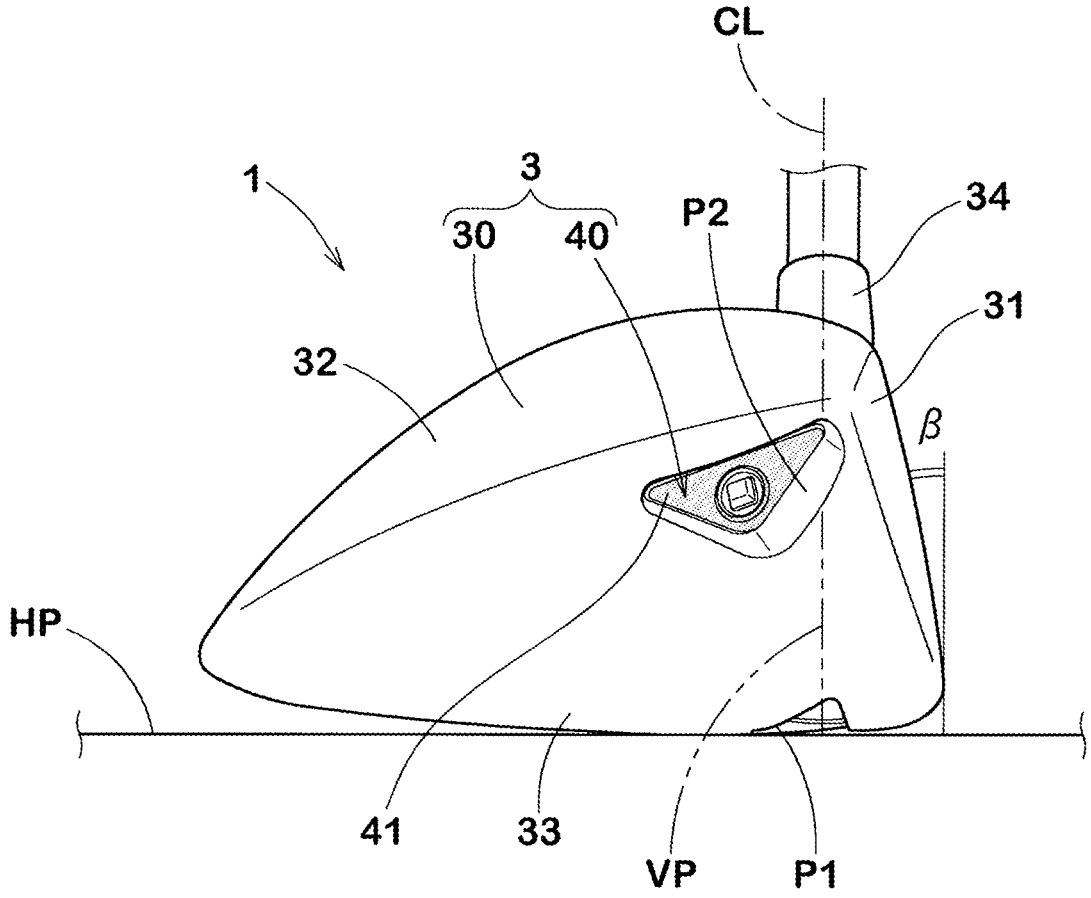
FIG. 3 is a side view of the golf club head as viewed from the toe side.
Figure 4:
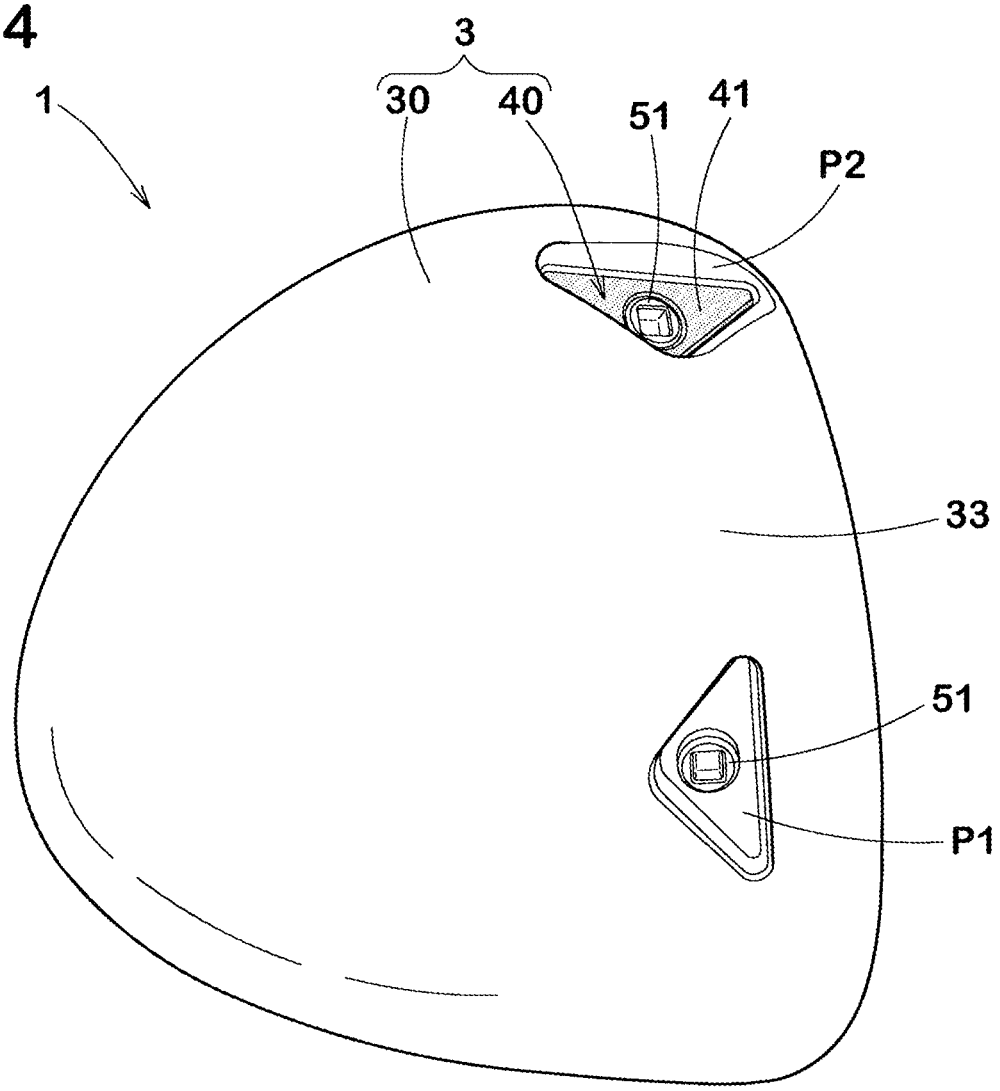
FIG. 4 is a bottom view of the golf club head.

FIGS. 2 to 4 are a front view, a side view as viewed from the toe side, and a bottom view of the golf club 1 in the present embodiment. In FIGS. 2 to 4, the golf club 1 is placed in its reference state.

In the present application, the reference state of the golf club 1 means a state of the golf club 1 which is placed on a horizontal plane HP at its lie angle $\alpha$ (FIG. 2) and loft angle $\beta$ (FIG. 3) specified for the golf club 1, and the center line CL of the shaft 2 is arranged in a reference vertical plane VP as shown in FIG. 3.

In this application, the golf club 1 is described as being in the reference condition unless otherwise noted.

Further, in the reference state of the golf club 1, the front-rear direction of the head is defined as the direction orthogonal to the reference vertical plane VP.

In the front-rear direction of the head, the front side is the side of the face 31, and the rear side is the opposite side.

The toe-heel direction of the head is defined as the direction parallel to both the reference vertical plane VP and the horizontal plane HP.

The up-down direction of the head is defined as the direction orthogonal to the horizontal plane HP.

[Shaft]

As shown in FIG. 1, the shaft 2 is configured in the shape of a straight pipe in this example. The shaft 2 has a center line CL.

The direction of the shaft center line CL is the axial direction of the shaft.

The shaft 2 has a first end 2*a* (butt end) and a second end 2*b* (tip end) in the axial direction of the shaft.

The shaft 2 may be made of, for example, a fiber reinforced resin or a metal material.

[Grip]

The grip 4 is attached to the first end 2*a* portion of the shaft 2.

Figure 5:
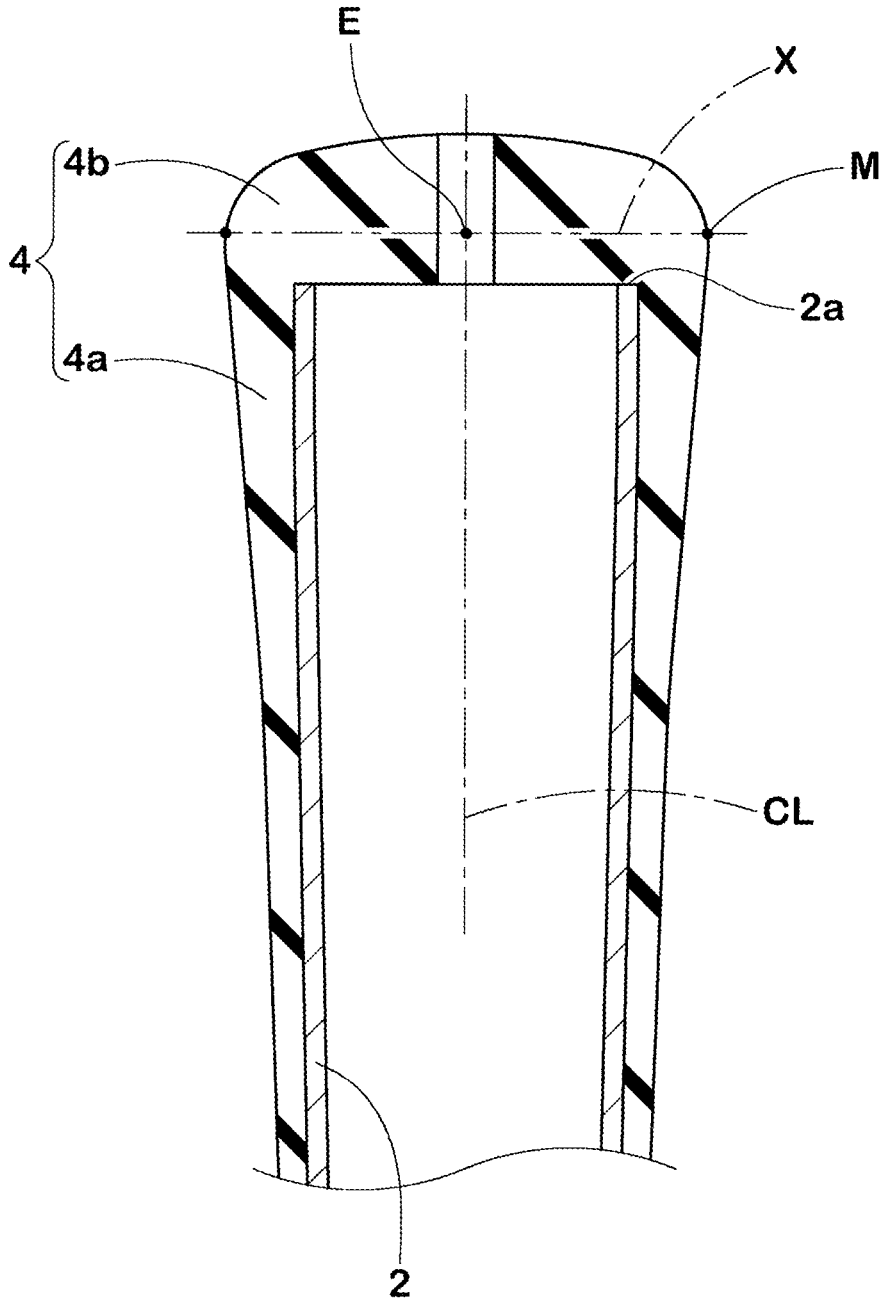
FIG. 5 is a cross-sectional view of a part of a grip of the golf club.

FIG. 5 is a cross-sectional view including the shaft center line CL, of a part of the grip 4. The grip 4 comprises, for example, a cylindrical grip portion 4*a* to be gripped by a golfer, and a closing portion 4*b* provided on one end of the grip portion 4*a*. The grip portion 4*a* defines the grip end E. In the present application, the "grip end" E means the intersection of the shaft center line CL and a plane X orthogonal to the shaft axis direction passing through a position M at which the largest outer diameter of the grip portion 4*a* occurs.

The material of the grip 4 is not particularly limited, but for example, rubber is preferred. As the rubber, for example, natural rubber, styrene-butadiene rubber, EPDM, isoprene rubber and a mixture thereof are preferable.

[Golf Club Head]

Figure 6:
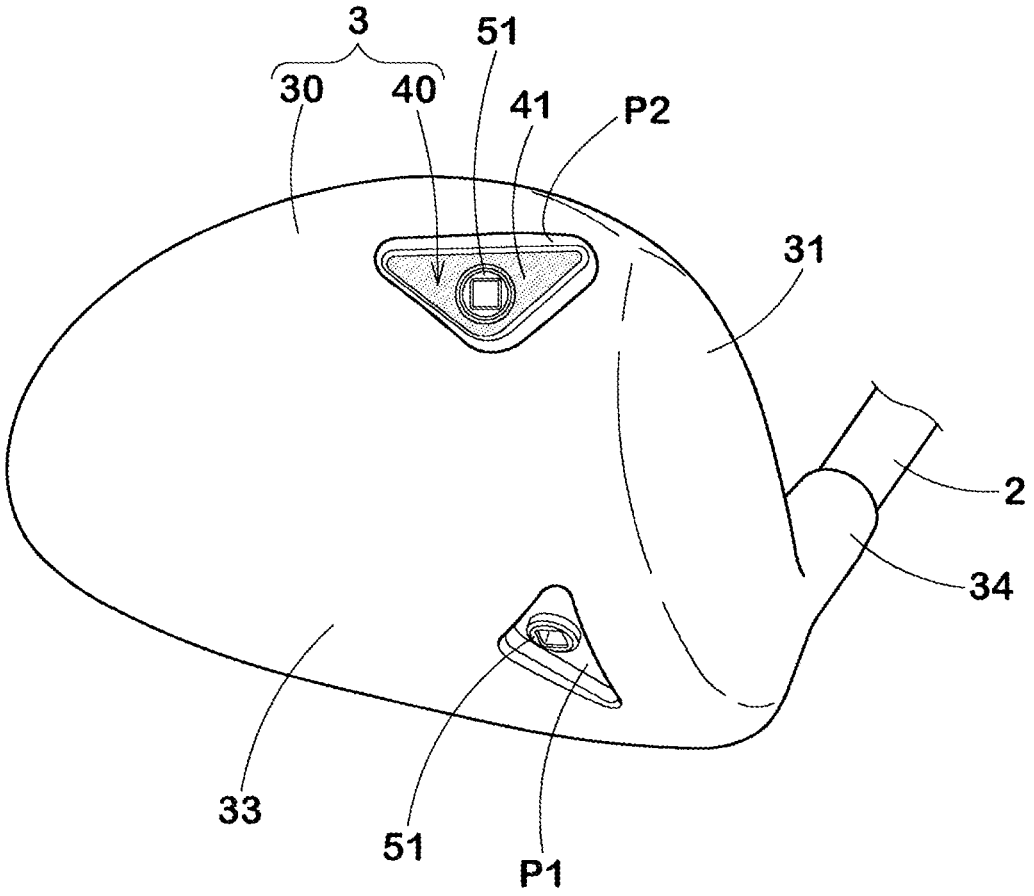
FIG. 6 is a perspective view of the golf club head as viewed from the toe side.
Figure 7:
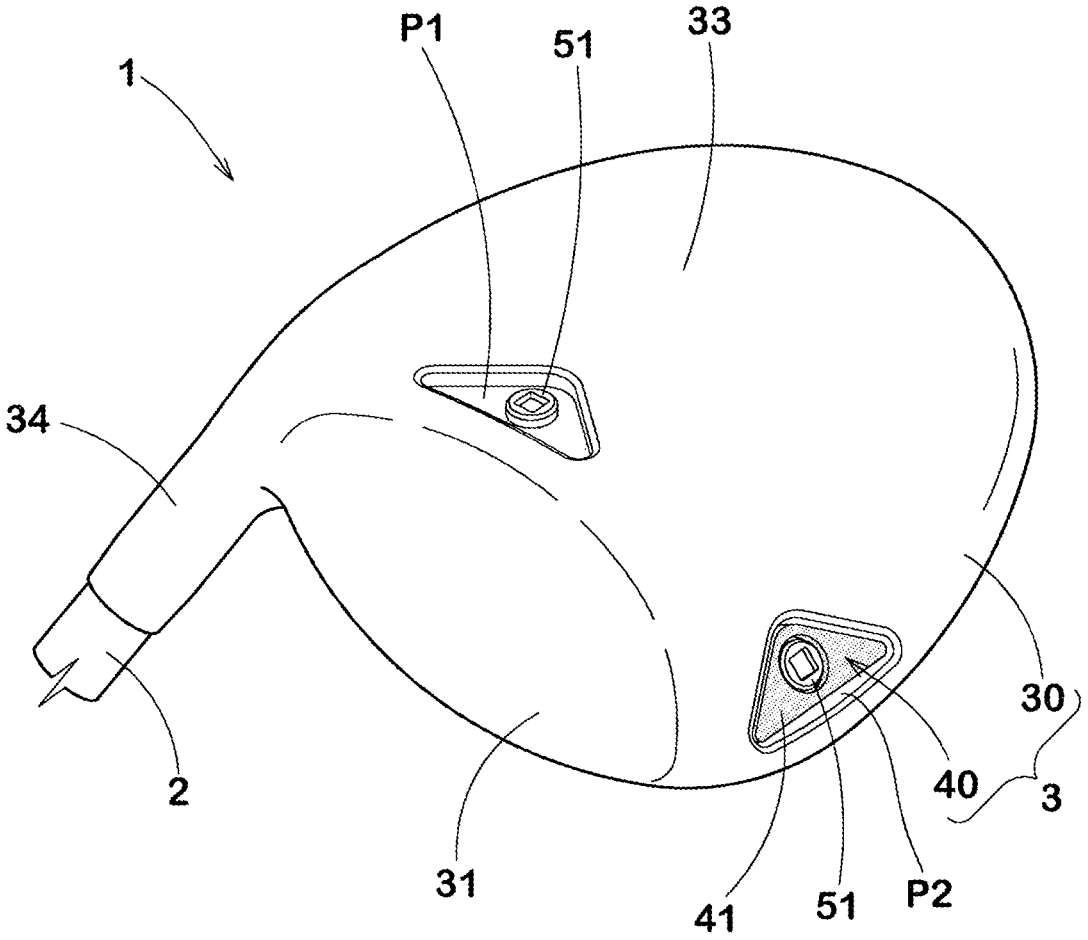
FIG. 7 is a perspective view of the golf club head as viewed from below.
Figure 8:
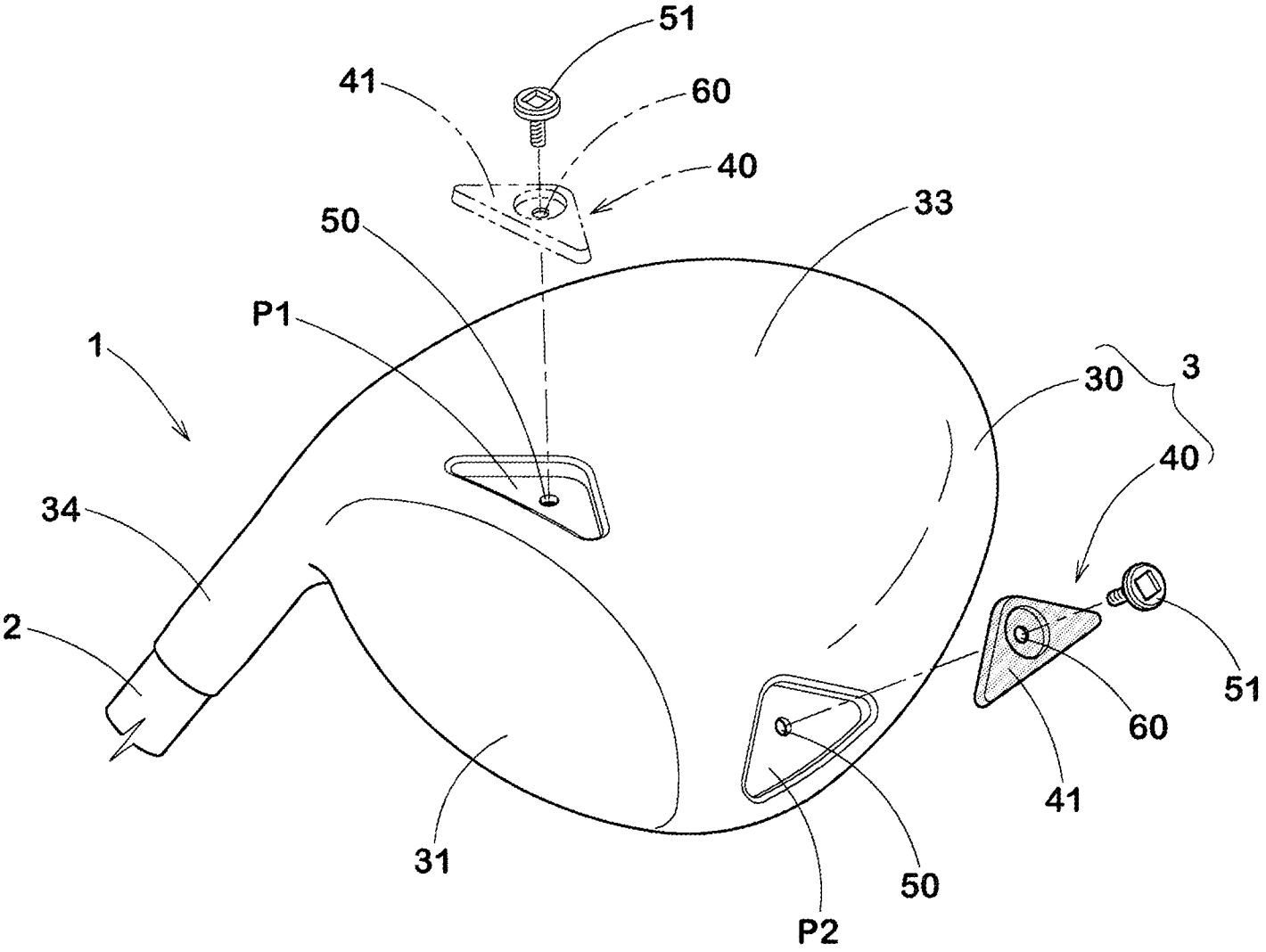
FIG. 8 is an exploded perspective view of the golf club head.

FIG. 6 is a perspective view of the golf club club 3 in the present embodiment as viewed from the toe side. FIG. 7 is a perspective view of the golf club club 3 as viewed from the lower side. FIG. 8 is an exploded perspective view of the golf club club 3 as viewed from the lower side. As shown in FIGS. 2 to 4 and 6 to 8, the golf club club 3 in the present embodiment is formed as a wood type. The golf club 1 in the present embodiment is accordingly a wood type.

In the present application, the "wood type" golf club head includes not only a driver but also a fairway wood such as a spoon or a buffy.

As another embodiment, the golf club 1 may be formed as an iron type, a hybrid type, a putter type, or the like.

The golf club club 3 is composed of a head main body 30 and at least one weight 40.

In this embodiment, the above-said at least one weight 40 is only one weight (hereinafter, "first weight 41").

[Head Main Body]

The head main body 30 includes, for example, a face 31, a crown 32, a sole 33, a hosel portion 34 and the like of the golf club club 3 as one body, and a hollow (not shown) is formed therein.

The face 31 forms a surface for hitting a ball.

The face 31 may be provided with a plurality of grooves extending in the toe-heel direction called face lines or score lines although not shown.

The crown 32 extends from the upper edge of the face 31 toward the rear of the head and forms the upper surface of the head. Therefore, the crown 32 is a portion visible in the plan view of the head main body 30. On the heel side of the crown 32, a hosel portion 34 for fixing the shaft 2 is formed.

The sole 33 extends from the lower edge of the face 31 toward the rear of the head and forms the bottom surface of the head. Therefore, the sole 33 is a portion visible in the bottom view (FIG. 4) of the head main body 30.

The head main body 30 is made of a metal material, for example. As the metal material, for example, stainless steel, maraging steel, titanium alloy, magnesium alloy, aluminum alloy and the like are suitably used. However, a part of the head main body 30 (for example, the crown 32) may be made of a non-metal material such as a fiber reinforced resin.

[Ports]

The head main body 30 is provided with a plurality of ports for attaching the first weight 41 to the head main body 30. In this embodiment, the plurality of ports are a first port P1 and a second port P2.

As another example, the plurality of ports may be three or more ports.

The first port P1 and the second port P2 are formed at different positions from each other.

In view of adjusting the center of gravity of the head, the positions of the first port P1 and the second port P2 are not particularly limited, and are appropriately determined so as to be able to set the center of gravity of the head at a desired position.

Specifically, the first port P1 and the second port P2 can be provided at any position of the head main body 30 except for the face 31 for hitting a ball.

In the present application, the "position" of the port P1 and P2 is defined by the position of the center of gravity of the weight 41 when the weight 41 is attached to the port.

In the present embodiment, both the first port P1 and the second port P2 are formed in the sole 33.

In such embodiment, since the first weight 41 is arranged to the sole 33, the center of gravity of the golf club club 3 can be lowered.

As another embodiment, at least one of the first port P1 and the second port P2 may be formed in the crown 32 (not shown).

As shown in FIG. 2, the first port P1 and the second port P2 may be formed apart from each other in the toe-heel direction.

For example, the second port P2 is located on the toe side of the first port 1. In this case, the center of gravity of the golf club head shifts toward the toe by attaching the first weight 41 to the second port P2. By attaching the first weight 41 to the first port P1, the center of gravity of the head shifts toward the heel.

Further, the first port P1 and the second port P2 may be provided apart from each other in the up-down direction of the head.

For example, the second port P2 may be located above the first port P1. In this case, by attaching the first weight 41 to the second port P2, the center of gravity of the head shift toward the upper side. By attaching the first weight 41 to the first port P1, the center of gravity of the head shifts toward the lower side.

Furthermore, as shown in FIG. 3, the first port P1 and the second port P2 may be provided apart from each other in the front-rear direction of the head. For example, the second port P2 may be located in front of the first port P1. In this case, by attaching the first weight 41 to the second port P2, the center of gravity of the head shifts toward the rear. By attaching the first weight 41 to the first port P1, the center of gravity of the head shifts toward the front.

In order to change the position of the center of gravity of the head, it is desirable that the linear distance L3 (shown in FIG. 9) between the center of gravity of the first weight 41 attached to the first port P1 and the center of gravity of the first weight 41 attached to the second port P2 is sufficiently large. Specifically, the linear distance L3 is preferably not less than 30 mm, more preferably not less than 40 mm, still more preferably not less than 50 mm.

[Port Configuration]

In the present embodiment, as shown in FIG. 8, each of the first port P1 and the second port P2 comprises a mounting hole 50 used for mounting the first weight 41, and a fixing device 51 for fixing the first weight 41 to the mounting hole 50.

In the present embodiment, the mounting hole 50 is a threaded screw hole penetrating the head main body 30. As another example, the mounting hole 50 may be configured as a bottomed recess.

In the present embodiment, the fixing device 51 is a screw.

In this application, the "screw" includes all devices capable of fastening two members to each other by being rotated. Therefore, the screw in the present embodiment includes a screw having a continuous spiral screw groove as shown in the figure, and a one-touch type screw capable of fastening two members with a small rotation of about 90 degrees.

Further, in the present embodiment, the fixing device 51 is formed as a member separate from the first weight 41. However, the fixing device 51 may be integrated with the first weight 41, for example. In this case, each port P1 and P2 may be composed of only the mounting hole 50.

Preferably, each of the first port P1 and the second port P2 may comprise a recess 37 capable of accommodating at least a part, more preferably the whole of the first weight 41, for example. Such recess 37 facilitates positioning of the first weight 41 to the port.

Further, when the first weight 41 is attached to the first port P1 or the second port P2, the protruding amount of the first weight 41 from the outer surface of the head main body 30 is reduced. This is useful for reducing the contact resistance with the ground and air resistance of the golf club club 3 during swing.

[Weight]

The first weight 41 is configured to be detachably attached to each of the first port P1 and the second port P2.

Further, the position of the first weight 41 can be changed from the first port P1 to the second port P2 and vice versa. In the embodiments shown in FIGS. 1 to 4 and 6 to 8, the first weight 41 is attached to the second port P2.

In the present embodiment, the first weight 41 is formed as, for example, a substantially triangular plate-shaped member.

Further, the first weight 41 in the present embodiment is provided with a through hole 60 for passing the fixing device 51 which is a screw.

As another example, the first weight 41 may be formed in various shapes such as a disk shape, a prism shape, and a columnar shape.

In the present embodiment, the procedure for attaching the first weight 41 to the head main body 30 is as follows. First, the through hole 60 of the first weight 41 is aligned with the mounting hole 50 of either the first port P1 or the second port P2.

Then, the fixing device 51 is fixed into the mounting hole 50, passing through the through hole 60 of the first weight 41. As a result, the first weight 41 is easily attached to the first port P1 or the second port P2 of the head main body 30.

Further, the first weight 41 fixed to one of the first port P1 and the second port P2 can be easily removed from the head main body 30 by removing the fixing device 51 from the mounting hole 50.

Then, the removed first weight 41 is attached to the other of the first port P1 and the second port P2 according to the above-described attachment procedure.

Therefore, the first weight 41 can change the position of the center of gravity of the golf club head as described above according to the position of the first weight 41 attached to the port P1 or P2.

Such change in the center of gravity of the head can be easily performed not only by the golf club manufacturer but also by the golfer himself.

It is preferable that the first weight 41 is made of a metal material having a specific gravity larger than that of the head main body 30. But, the material of the first weight 41 is not particularly limited as long as it has a weight.

Further, the weight of the first weight 41 is not particularly limited, but in order to effectively adjust the center of gravity of the head, it is preferable that the weight is, for example, 3 grams or more.

[Linear Distance from the Grip End to the First Weight]

Figure 9:
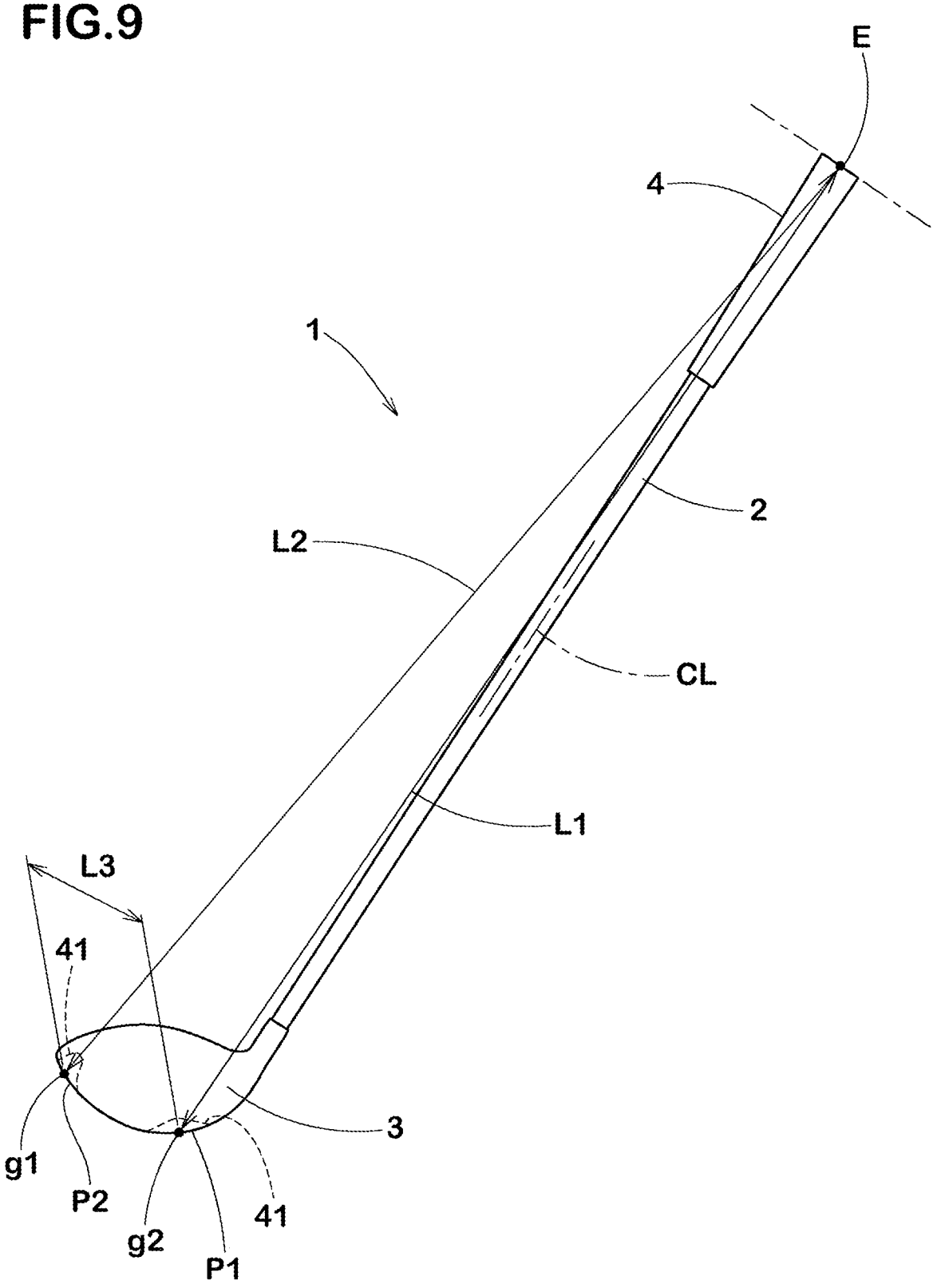
FIG. 9 is a schematic front view of the golf club for explaining the linear distance from the grip end to the center of gravity of the weight at each port.

FIG. 9 is a schematic view of the golf club 1 according to the present embodiment.

As shown in FIG. 9, the golf club 1 has a linear distance L1 from the grip end E to the gravity center position g1 of the first weight 41 when attached to the first port P1, and a linear distance L2 from the grip end E to the gravity center position g2 of the first weight 41 when attached to the second port P2. The difference between the linear distances L1 and L2 (namely, absolute value IL1−L2I) is not more than 20 mm.

The feeling of the golf club 1 when swinging (also referred to as swinging comfort, including the feeling of weight when swinging) is greatly affected by the centrifugal force acting on the golf club club 3 during swing. In other words, even if the center of gravity of the head is changed, if the change in the centrifugal force is small, the feeling at the time of swing does not change so much.

The inventors conducted various experiments based on the above findings. And it was found that, by reducing the difference between the maximum value and the minimum value of the linear distances L1 and L2 to 20 mm or less, the centrifugal force acting on the golf club club 3 during swing became almost constant even if the first weight 41 is attached to either the first port P1 or the second port P2, and thereby the feeling at the time of swing was almost unchanged. Therefore, the golf club 1 of the present embodiment can change the position of the center of gravity of the head without changing the feeling at the time of swing (swing comfort).

In order to reduce the change in the centrifugal force when the mounting position of the first weight 41 is changed between the first port P1 and the second port P2, it is desirable that the difference between the linear distances L1 and L2 is as small as possible.

From such a viewpoint, the difference between the linear distances L1 and L2 is preferably not more than 15 mm, more preferably not more than 10 mm, still more preferably not more than 5 mm, most preferably 0 mm.

[Moment of Inertia at the Grip End]

As described above, by defining the difference between the maximum value and the minimum value of the linear distances L1 and L2 of the golf club 1, the difference between a maximum value and a minimum value of the moment of inertia at the grip end E can be reduced if the mounting position of the first weight 41 is changed between or among the ports (between the first port P1 and the second port P2).

Therefore, according to the present disclosure, the difference between a maximum value and a minimum value of the linear distances and/or the difference between a maximum value and a minimum value of the moment of inertia at the grip end E are specifically-defined.

For example, in the golf club 1, it is desirable that the difference between the maximum value and the minimum value of the moment of inertia at the grip end E is 0.10% or less when the mounting position of the first weight 41 is changed between or among a plurality of ports (between the first port P1 and the second port P2).

More specifically, the difference between the moment of inertia MI1 at the grip end E when the first weight 41 is attached to the first port P1 and the moment of inertia MI2 at the grip end E when the first weight 41 is attached to the second port P2 is not more than 0.09%, more preferably not more than 0.08%, most preferably zero.

In the present application, the difference between the moments of inertia MI1 and MI2 is calculated as a percentage of (MI2−MI1)/MI2 when MI2>MI1, and (MI1−MI2)/MI1 when MI1>>MI2.

Further, in the present specification, the moment of inertia at the grip end E can be obtained by converting the value of the moment of inertia around the center of gravity of the golf club measured using the inertia moment measuring device by using the parallel axis theorem (the measuring method is as described in the Japanese Patent Publication No. 5756732 by the present applicant).

As the difference in the moment of inertia at the grip end E when the mounting position of the first weight 41 is changed between the first port P1 and the second port P2, is reduced to zero or limited in a certain range, the change in the feeling at the time of swing can be more effectively suppressed.

Other Embodiments

Figure 10:
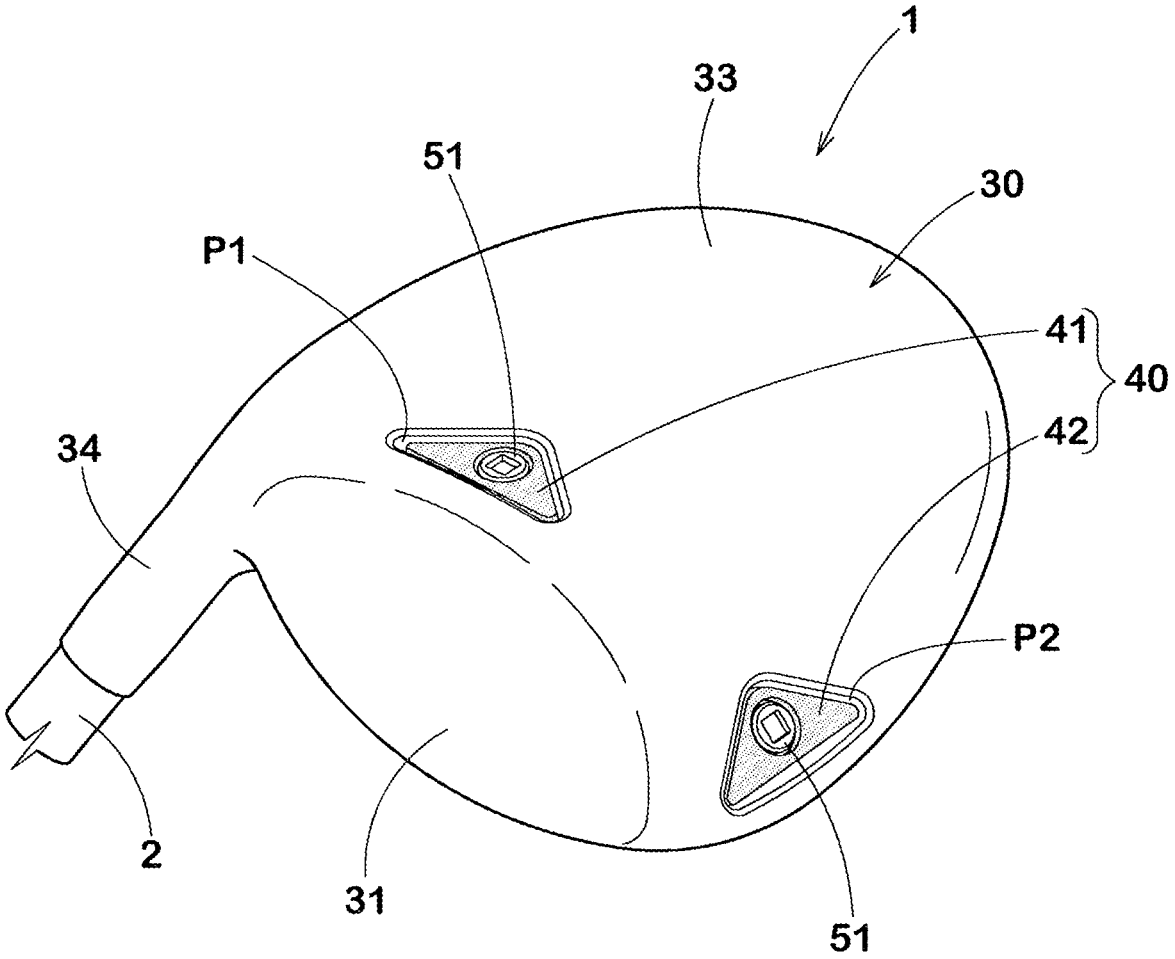
FIG. 10 is a perspective view of another example of the golf club head as viewed from below.
Figure 11:
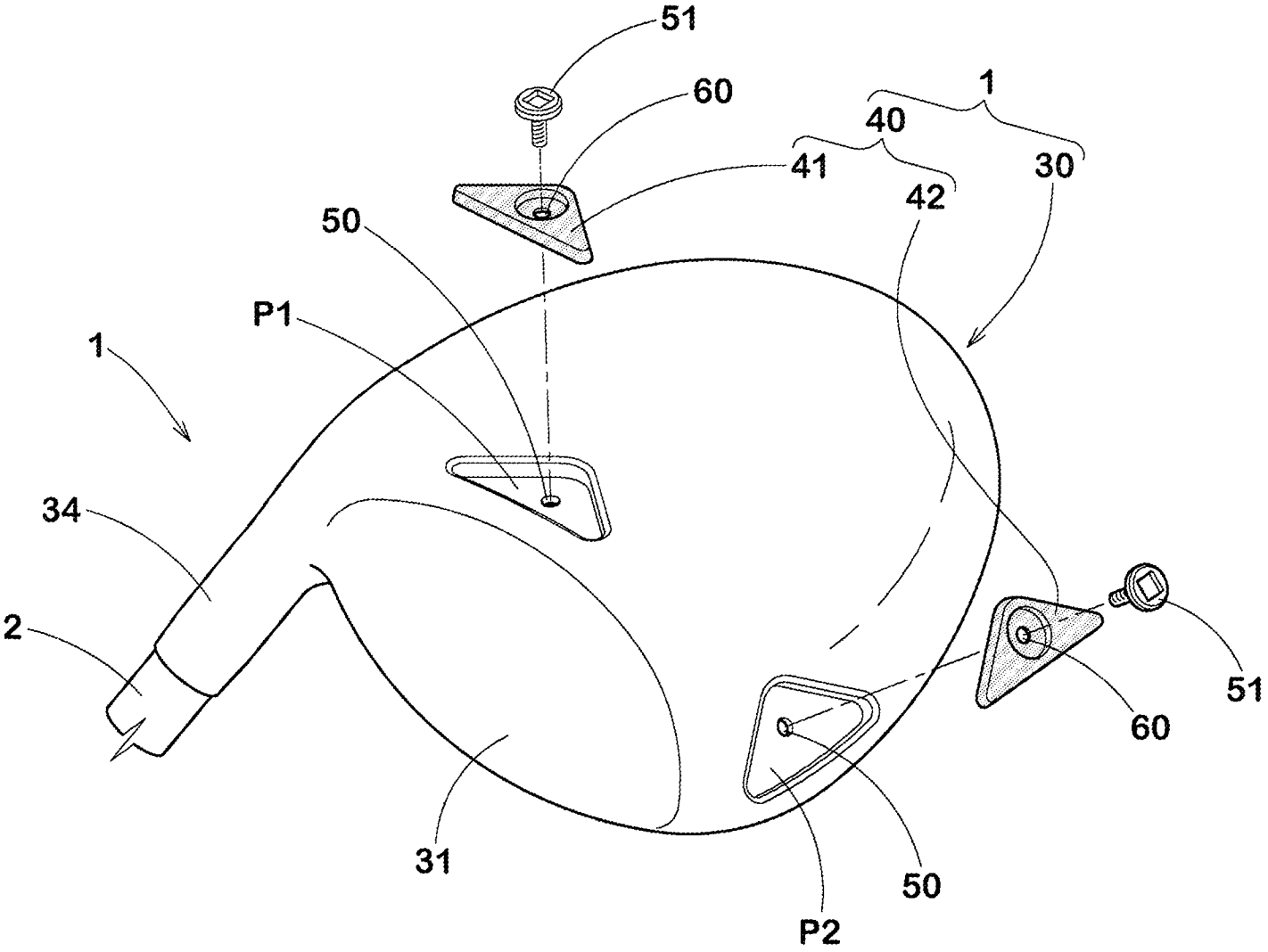
FIG. 11 is an exploded perspective view of the golf club head shown in FIG. 10.

FIGS. 10 and 11 show a golf club 1 as another embodiment of the present disclosure. In this embodiment, the above-said at least one weight 40 is a plurality of weights having different weights from each other. Specifically, the weight 40 includes a second weight 42 in addition to the above-mentioned first weight 41.

On the other hand, the plurality of ports are the above-mentioned first port P1 and second port P2.

Similar to the first weight 41, the second weight 42 is configured to be attachable to and detachable from each of the first port P1 and the second port P2, and thus, the mounting position can be changed between the first port P1 and the second port P2.

In the example of FIGS. 10 and 11, the first weight 41 is attached to the first port P1, and the second weight 42 is attached to the second port P2. The position of the center of gravity of the head can be changed by exchanging the positions of the first weight 41 and the second weight 42.

Also in this embodiment, the difference between the maximum value and the minimum value of the linear distance from the grip end E to the centers of gravity of the weights 41 and 42 at the ports P1 and P2 is set to be 20 mm or less.

More specifically, when the linear distance from the grip end E to the center of gravity of the first weight 41 attached to the first port P1 is L1a, the linear distance from the grip end E to the center of gravity of the first weight 41 attached to in the second port P2 is L1b, the linear distance from the grip end E to the center of gravity of the second weight 42 attached to the first port P1 is L2a, and the linear distance from the grip end E to the center of gravity of the second weight 42 attached to the second port P2 is L2b, the difference between the maximum value and the minimum value of the L1a, L1b, L2a and L2b is 20 mm or less.

Therefore, in this embodiment too, even when the first weight 41 and the second weight 42 are exchanged between the first port P1 and the second port P2, the centrifugal force acting on the golf club club 3 at the time of swing is substantially constant. As a result, it is possible to suppress a change in swing feeling. Therefore, in the golf club 1 in this embodiment, the position of the center of gravity of the head can be changed without changing the feeling at the time of swing (swinging comfort).

In order to reduce the change in the centrifugal force when the positions of the first weight 41 and the second weight 42 are exchanged between the first port P1 and the second port P2, it is preferred that the difference between the maximum value and the minimum value of the linear distances (L1a, L1b, L2a and L2b) is as small as possible.

From this point of view, the difference between the maximum value and the minimum value of the linear distances (L1a, L1b, L2a and L2b) is preferably not more than 15 mm, more preferably not more than 10 mm, still more preferably not more than 5 mm, most preferably 0 mm.

In this embodiment, the first weight 41 and the second weight 42 have the same shape but are made of different materials having different specific densities from each other. Further, the first weight 41 and the second weight 42 have their centers of gravity at the same position of the above-mentioned same shape.

Therefore, in this embodiment, the linear distances L1a and L2a with respect to the first port P1 are equal to each other, and the linear distances L1b and L2b with respect to the second port P2 are equal to each other.

As another embodiment, the first weight 41 and the second weight 42 may have different shapes.

In this embodiment, the number of weights and the number of ports are two each and are the same.

Figure 12:
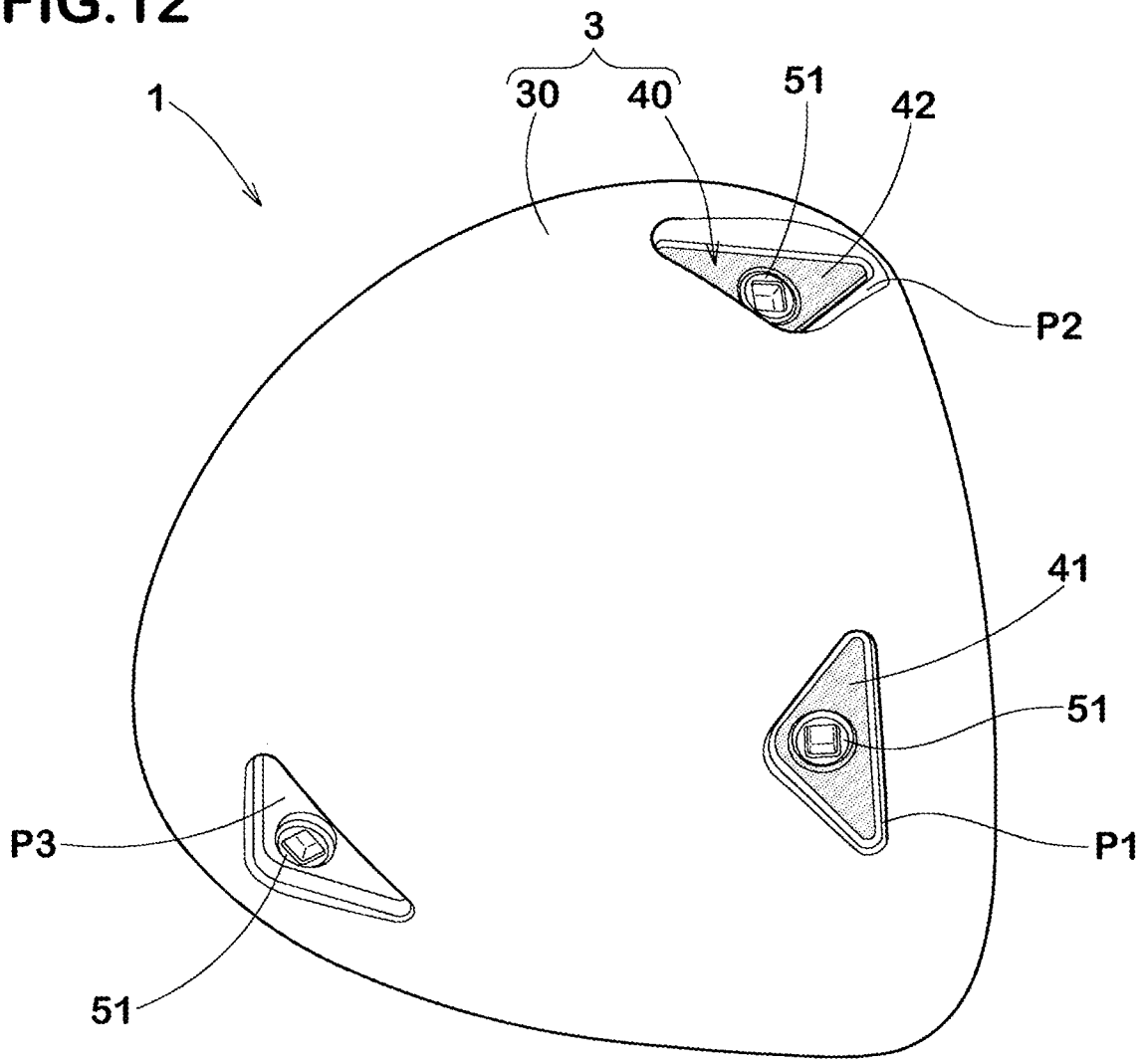
FIG. 12 is a bottom view of another example of the golf club head.

As another embodiment, the above-said at least two ports may be three ports, namely, an additional third port P3 may be provided as shown in FIG. 12. In this case, the number of ports of the golf club club 3 is larger than the number of the weights.

However, the above-said at least one weight 40 may be three or more weights.

While detailed description has been made of preferable embodiments of the present disclosure, the present disclosure can be embodied in various forms without being limited to the illustrated embodiments.

Comparison Tests

In order to confirm the effects of the present disclosure, comparison tests were conducted. Wood-type golf clubs having specifications shown in Table 1 were experimentally manufactured based on the structure shown in FIGS. 1 to 8. The first weight (8 grams) and the second weight (2 grams) were first attached to the first port and the second port, respectively. Then their positions were exchanged between the first port and the second port, and the change in the position of the center of gravity of the golf club head and the change in the feeling at the time of swing were evaluated.

In Table 1, CG-A, CG-B and CG-C indicate the positions of the centers of gravity of the head, wherein "CG-A" is a distance between the center of gravity of the head and a straight line drawn perpendicularly to the shaft axis passing through the neck end when the head is viewed from the club face side;

"CG-B" is a distance between the center of gravity of the head and a straight line which coincides with the center line of the shaft when the head is viewed from the club face side; and "CG-C" is a distance between the center of gravity of the head and a vertical plane passing through the shaft axis when the head is viewed from the crown side.

The feeling at the time of swing was evaluated by 20 average golfers (handicap 10 to 20).

Each golfer swung each golf club before and after the exchanging of the positions of the weights, and about the feeling at the time of swing, a questionnaire survey of the 20 golfers was conducted.

The results are shown in Table 1.

TABLE 1

| | com-parative Ex. 1 | com-parative Ex. 2 | comparative Ex. 3 |
|---|---|---|---|
| Club total length (mm) | 1155.7 | 1155.7 | 1155.7 |
| Head volume (cc) | 460 | 460 | 460 |
| Head main body mass (g) | 188.1 | 188.1 | 188.1 |
| 1st port position | sole (heel side) | sole (heel side) | crown (center) |
| 2nd port position | sole (toe side) | sole (toe side) | sole (toe side) |
| linear distance L1 (mm) | 1160 | 1170 | 1170 |
| linear distance L2 (mm) | 1200 | 1200 | 1200 |
| difference \|L1-L2\| (mm) | 40 | 30 | 30 |
| linear distance L3 (mm) | 107.5 | 54.3 | 67.8 |
| inertial moment MI1 (g sq · cm) | 2819830 | 2820409 | 2820708 |
| inertial moment MI2 (g sq · cm) | 2824443 | 2824252 | 2824014 |
| inertial moment difference | 0.16% | 0.14% | 0.12% |
| Change in position of center of gravity due to weight position change (mm) | | | |
| CG-A (1st port; 8 gram weight, 2nd port: 2 gram weight) | 70.9 | 71.3 | 71.5 |
| CG-B (1st port; 8 gram weight, 2nd port: 2 gram weight) | 36.0 | 35.9 | 37.3 |
| CG-C (1st port; 8 gram weight, 2nd port: 2 gram weight) | 16.8 | 17.1 | 20.0 |
| CG-A (1st port: 2 gram weight, 2nd port: 8 gram weight) | 71.9 | 72.1 | 72.0 |
| CG-B (1st port: 2 gram weight, 2nd port: 8 gram weight) | 38.7 | 37.3 | 39.0 |
| CG-C (1st port: 2 gram weight, 2nd port: 8 gram weight) | 18.2 | 17.0 | 19.0 |
| Feeling during swing (questionnaire survey of 20 golfers) | | | |
| Number of golfers who felt | | | |
| no change | 0 | 0 | 3 |
| slight change | 1 | 3 | 7 |
| certain change | 5 | 7 | 9 |
| large change | 14 | 10 | 1 |

TABLE 1-continued

| | Example 1 | Example 2 | Example 3 | Example 4 |
|---|---|---|---|---|
| Club total length (mm) | 1155.7 | 1155.7 | 1155.7 | 1155.7 |
| Head volume (cc) | 460 | 460 | 460 | 460 |
| Head main body mass (g) | 188.1 | 188.1 | 188.1 | 188.1 |
| 1st port position | sole (heel side) | sole (heel side) | sole (heel side) | sole (heel side) |
| 2nd port position | sole (toe side) | sole (toe side) | sole (toe side) | crown (toe side) |
| linear distance L1 (mm) | 1170 | 1170 | 1170 | 1170 |
| linear distance L2 (mm) | 1190 | 1185 | 1180 | 1170 |
| difference \|L1-L2\| (mm) | 20 | 15 | 10 | 0 |
| linear distance L3 (mm) | 76.2 | 66.1 | 65.3 | 88.1 |
| inertial moment MI1 (g sq · cm) | 2819898 | 2819663 | 2819432 | 2819425 |
| inertial moment MI2 (g sq · cm) | 2822203 | 2821261 | 2820338 | 2820309 |
| inertial moment difference | 0.08% | 0.06% | 0.03% | 0.03% |
| Change in position of center of gravity due to weight position change (mm) | | | | |
| CG-A (1st port; 8 gram weight, 2nd port: 2 gram weight) | 71.2 | 71.1 | 71.1 | 71.0 |
| CG-B (1st port; 8 gram weight, 2nd port: 2 gram weight) | 35.9 | 35.8 | 35.7 | 36.4 |
| CG-C (1st port; 8 gram weight, 2nd port: 2 gram weight) | 17.7 | 17.8 | 17.8 | 17.2 |
| CG-A (1st port: 2 gram weight, 2nd port: 8 gram weight) | 71.7 | 71.5 | 71.2 | 71.0 |
| CG-B (1st port: 2 gram weight, 2nd port: 8 gram weight) | 37.5 | 36.6 | 36.2 | 39.0 |
| CG-C (1st port: 2 gram weight, 2nd port:8 gram weight) | 19.6 | 19.7 | 19.6 | 17.6 |
| Feeling during swing (questionnaire survey of 20 golfers) | | | | |
| Number of golfers who felt | | | | |
| no change | 10 | 11 | 13 | 17 |
| slight change | 5 | 7 | 6 | 2 |
| certain change | 3 | 1 | 1 | 1 |
| large change | 2 | 1 | 0 | 0 |

From the test results, it was confirmed that the golf clubs according to the present disclosure can change the position of the center of gravity of the head while suppressing the change in the feeling at the time of swing.

Statement of the Present Disclosure

The present disclosure is as follows:

Disclosure 1. A golf club comprising a shaft, a golf club head attached to one of ends of the shaft, and a grip attached to the other of the ends of the shaft and defining a grip end, wherein the golf club head comprises a head main body and at least one weight, the head main body is provided with a plurality of ports for attaching said at least one weight to the head main body, said at least one weight is configured to be able to be attached to and detached from each of said plurality of ports so that, by changing a position or positions of said at least one weight, the position of the center of gravity of the head is changed, and a difference between a maximum value and a minimum value of linear distances from the grip end to positions of the respective ports is not more than 20 mm, wherein the position of each of the ports is defined by the center of gravity of the weight attached to the port.

Disclosure 2. The golf club according to Disclosure 1, wherein said plurality of ports are two ports, and a linear distance between the center of gravity of said at least one weight when attached to one of the two ports and the center of gravity of said at least one weight when attached to the other of the two ports is not less than 50 mm.

Disclosure 3. The golf club according to Disclosure 1 or 2, wherein the head main body includes a face, a crown and a sole of the golf club head, and at least one of said plurality of ports is provided in the sole.

Disclosure 4. The golf club according to Disclosure 1, 2, or 3, wherein said plurality of ports are separated from each other in a toe-heel direction of the golf club head.

Disclosure 5. The golf club according to any one of Disclosures 1 to 4, wherein said plurality of ports are separated from each other in an up-down direction of the golf club head.

Disclosure 6. The golf club according to any one of Disclosures 1 to 5, wherein said plurality of ports are separated from each other in a front-rear direction of the golf club head.

Disclosure 7. The golf club according to any one of Disclosures 1 to 6, wherein each of said plurality of ports is provided with a recess for accommodating at least a part of the weight attached thereto.

Disclosure 8. The golf club according to any one of Disclosures 1 to 7, wherein said at least one weight is only one weight.

Disclosure 9. The golf club according to any one of Disclosures 1 to 7, wherein said at least one weight are a plurality of weights having different weights from each other.

Disclosure 10. The golf club according to Disclosure 9, wherein said plurality of weights have the same shape.

Disclosure 11. The golf club according to Disclosure 9 or 10, wherein the number of said plurality of weights is the same as the number of said plurality of ports.

Disclosure 12. The golf club according to any one of Disclosures 1 to 11, wherein the number of said plurality of ports is larger than the number of said at least one weight.

Disclosure 13. The golf club according to any one of Disclosures 1 to 12, wherein a difference between a maximum value and a minimum value of a moment of inertia at the grip end when said at least one weight is repositioned between or among said plurality of ports is not more than 0.10.

Disclosure 14. A golf club comprising a shaft, a golf club head attached to one of ends of the shaft, and a grip attached to the other of the ends of the shaft and defining a grip end, wherein the golf club head comprises a head main body and at least one weight, the head main body is provided with a plurality of ports for attaching said at least one weight to the head main body, said at least one weight is configured to be able to be attached to and detached from each of said plurality of ports so that, by changing a position or positions of said at least one weight, the position of the center of gravity of the head is changed, and a difference between a maximum value and a minimum value of a moment of inertia at the grip end when said at least one weight is repositioned between or among said plurality of ports is not more than 0.10.

DESCRIPTION OF THE REFERENCE SIGNS

1 golf club
2 shaft
3 head
4 grip
30 head main body
31 face
32 crown
33 sole
40 weight
41 first weight
42 second weight
P1 first port
P2 second port
P3 third port

The invention claimed is:

1. A golf club comprising a shaft, a golf club head attached to one of ends of the shaft, and a grip attached to the other of the ends of the shaft and defining a grip end, wherein the golf club head comprises a head main body and at least one weight, the head main body is provided with a plurality of ports for attaching said at least one weight to the head main body, said at least one weight is configured to be able to be attached to and detached from each of said plurality of ports so that, by changing a position or positions of said at least one weight, the position of the center of gravity of the head is changed, and a difference between a maximum value and a minimum value of linear distances from the grip end to positions of the respective ports is not more than 20 mm, wherein the position of each of the ports is defined by the center of gravity of the weight attached to the port.

2. The golf club according to claim 1, wherein said plurality of ports are two ports, and a linear distance between the center of gravity of said at least one weight when attached to one of the two ports and the center of gravity of said at least one weight when attached to the other of the two ports is not less than 50 mm.

3. The golf club according to claim 1, wherein the head main body includes a face, a crown and a sole of the golf club head, and at least one of said plurality of ports is provided in the sole.

4. The golf club according to claim 1, wherein said plurality of ports are separated from each other in a toe-heel direction of the golf club head.

5. The golf club according to claim 1, wherein said plurality of ports are separated from each other in an up-down direction of the golf club head.

6. The golf club according to claim 1, wherein said plurality of ports are separated from each other in a front-rear direction of the golf club head.

7. The golf club according to claim 1, wherein each of said plurality of ports is provided with a recess for accommodating at least a part of the weight attached thereto.

8. The golf club according to claim 1, wherein said at least one weight is only one weight.

9. The golf club according to claim 1, wherein said at least one weight is a plurality of weights having different weights from each other.

10. The golf club according to claim 9, wherein said plurality of weights have the same shape.

11. The golf club according to claim 9, wherein the number of said plurality of weights is the same as the number of said plurality of ports.

12. The golf club according to claim 1, wherein the number of said plurality of ports is larger than the number of said at least one weight.

13. The golf club according to claim 1, wherein a difference between a maximum value and a minimum value of a moment of inertia at the grip end when said at least one weight is repositioned between or among said plurality of ports is not more than 0.10.

14. A golf club comprising a shaft, a golf club head attached to one of ends of the shaft, and a grip attached to the other of the ends of the shaft and defining a grip end, wherein the golf club head comprises a head main body and at least one weight, the head main body is provided with a plurality of ports for attaching said at least one weight to the head main body, said at least one weight is configured to be able to be attached to and detached from each of said plurality of ports so that, by changing a position or positions of said at least one weight, the position of the center of gravity of the head is changed, and a difference between a maximum value and a minimum value of a moment of inertia at the grip end when said at least one weight is repositioned between or among said plurality of ports is not more than 0.10.

15. The golf club according to claim 14, wherein each of said plurality of ports is provided with a recess for accommodating at least a part of the weight attached thereto.

16. The golf club according to claim 15, wherein said at least one weight is a plurality of weights having different weights.

17. The golf club according to claim 16, wherein said plurality of weights have the same shape.

18. A golf club comprising a shaft, a golf club head attached to one of ends of the shaft, and a grip attached to the other of the ends of the shaft and defining a grip end, wherein the golf club head comprises a head main body and at least one weight, the head main body is provided with a plurality of positions configured for attaching said at least one weight to the head main body, said at least one weight is configured to be able to be attached to and detached from each of said plurality of positions of the head main body so that the position of the center of gravity of the head is changed by changing a position or positions of said at least one weight between or among said plurality of positions, and a difference between a maximum value and a minimum value of a moment of inertia at the grip end when said at least one weight is repositioned between or among said plurality of positions is not more than 0.10.

* * * * *